US009849328B1

(12) United States Patent
Fulks

(10) Patent No.: US 9,849,328 B1
(45) Date of Patent: Dec. 26, 2017

(54) METHOD AND APPARATUS FOR BI-DIRECTIONAL ANKLE EXERCISE MOVEMENTS

(76) Inventor: Kent Fulks, Dallas, TX (US)

( * ) Notice: Subject to any disclaimer, the term of this patent is extended or adjusted under 35 U.S.C. 154(b) by 1064 days.

(21) Appl. No.: 13/374,232

(22) Filed: Dec. 19, 2011

(51) Int. Cl.
*A63B 21/015* (2006.01)
*A63B 69/38* (2006.01)
*A63B 23/10* (2006.01)
*A63B 21/00* (2006.01)

(52) U.S. Cl.
CPC ..... *A63B 21/4015* (2015.10); *A63B 23/10* (2013.01)

(58) Field of Classification Search
CPC ..... A63B 23/08; A63B 2071/0644; A63B 2071/0652; A63B 2071/0655; A63B 2071/0691; A63B 2220/17; A63B 2220/30; A63B 2220/34
USPC ..... 482/79–80, 93–101
See application file for complete search history.

(56) References Cited

U.S. PATENT DOCUMENTS 3,020,046 A * 2/1962 Hotas ..... 482/79
4,452,447 A * 6/1984 Lepley et al. ..... 482/79
5,368,536 A * 11/1994 Stodgell ..... 482/79
5,897,464 A * 4/1999 Mcleod ..... 482/79
6,277,057 B1 * 8/2001 Hayden ..... 482/79
7,794,367 B2 * 9/2010 Hall et al. ..... 482/79
7,892,154 B1 * 2/2011 Alexa ..... 482/112
8,206,267 B2 * 6/2012 Holden et al. ..... 482/4
8,403,817 B2 * 3/2013 Ferguson et al. ..... 482/79
2005/0137065 A1 * 6/2005 Zoller et al. ..... 482/117
2005/0239611 A1 * 10/2005 Commisso ..... 482/93
2007/0027001 A1 * 2/2007 Alessandri et al. ..... 482/51
2012/0172176 A1 * 7/2012 Zhang et al. ..... 482/8

* cited by examiner

*Primary Examiner* — Stephen Crow
(74) *Attorney, Agent, or Firm* — Braxton, Hilton & Perrone, PLLC

(57) ABSTRACT

Apparatus for bi-directional ankle exercise movements has a main-frame with a seat and upwardly extending columns at either side to support a "U" shaped sub-frame, mounted so that it pivots about a horizontal axis passing very nearly through the ankles of a seated user and interconnecting linkages simultaneously enforcing ankle inversion, with plantarflexion and then ankle eversion, with dorsiflexion, about perpendicularly intersecting axes, while resisting such movements, so as to provide bidirectional ankle exercises according to a progressive resistance program, thus strengthening the ankle muscle groups for enhanced balance and dynamic stability.

17 Claims, 6 Drawing Sheets

METHOD AND APPARATUS FOR BI-DIRECTIONAL ANKLE EXERCISE MOVEMENTS

TECHNICAL FIELD

This invention relates generally to methods and apparatus for physical rehabilitation through exercise, such as devices that exercise those muscles which power and articulate the ankles and more particularly, such devices wherein the user's movements are opposed by a selected resistance.

BACKGROUND OF THE INVENTION

Often athletes and many non-athletes utilize weight lifting or weight training exercises to build muscle strength, to prevent injury, or to improve overall condition and appearance. Typically, weight training exercises are performed with either exercise machines or free weights, such as barbells with weighted plates or dumbbells. Exercise machines in general are adapted to provide resistance for specific upper or lower body movements, but none no prior art exercise machines are adapted to provide resistance for the normal range of ankle movements.

Gait parameters, static balance and dynamic stability tend to deteriorate as we age. While there are sensory factors contributing to the loss, a primary cause is the regression of ankle strength and flexibility. This loss of strength and flexibility causes a strategy shift in stability control among the elderly, moving away from foot and ankle control towards hip movements for maintaining balance and dynamic stability. This change is not widely appreciated, except by professionals involved in rehabilitation training, and the degree of change will vary in individuals cases. Through experience, physical therapists have developed various floor exercises for addressing the need which, while helpful, are limited in scope and can not provide the significant benefits of progressive resistance training.

Certain weight resistance machines, specifically calf raise machines and leg press machines, do provide linear, unidirectional weight training for the legs and ankles. A traditional calf raise machine provides sagittal plane resistance training for the ankle joint. The prime mover or "agonist" is the muscle group responsible for joint action during an exercise. The muscles acting at the ankles during a calf raise exercise are the plantarflexors, while all other muscles surrounding the joint are essentially uninvolved. However, the muscular responses needed to maintaining stability must act in planes throughout 360° around the ankles. Complex muscle groups act to flex the ankles as required for maintaining stability. These ankle flexions or movements are briefly described as eversion or inversion in combination with plantar or dorsal flexion.

Plantarflexion is movement of the ankle which increases the angle between the tibia bone (shin) and top of the foot, giving the appearance of pointing the toes. Dorsiflexion is movement of the ankle which decreases the angle between the shin and the top of the foot, bringing the top of the foot closer to the shin. Inversion is turning the ankle and foot inward, which would give the appearance of putting the soles of the feet together. Eversion is turning the ankle and foot outward.

The first muscle group acts for inversion:

The tibialis anterior acts for inversion and dorsiflexion.

The tibialis Posterior acts for inversion and plantarflexion.

The flexor digitorum longus acts for inversion and plantarflexion.

The soleus and gastrocnemius act for plantarflexion.

The second muscle group acts for eversion:

The extensor digitorum longus acts for eversion and dorsiflexion.

The peroneus longus acts for eversion and plantarflexion.

The peroneus brevis acts for eversion and plantarflexion.

It is noteworthy that, aside from the soleus and gastrocnemius, which act solely for plantarflexion, the other ankle muscle groups have compound, bidirectional functionality. To varying degrees maintaining stability involves every one of the above muscles, according to the direction in which stability is challenged. Forward stability is maintained by plantarflexors responses and rearward stability is maintained by an opposite dorsiflexor response. Lateral stability is maintained by invertor/evertor muscle group responses. Since these muscles act together in diverse harmony, they exemplify muscle groups which cannot be effectively exercised and developed by movements confined to a single plane. While there are helpful floor exercises, calf raise and leg press machines, the provision of progressive, bidirectional resistance training for these muscle groups is unknown to the prior art.

A skilled physical therapist might manipulate the foot and ankle through an appropriate range of motion, so as to improve flexibility, but without resistance there can be no beneficial strengthening. In order to provide some strengthening, the therapist might enforce ankle inversion accompanied by plantarflexion against the patient's resistance and then ankle eversion accompanied by dorsiflexion. However, if it were possible to provide resistance to such movements according to a progressive weight training program, the associated muscles could be strengthened to a degree not possible with prior art methodology and equipment.

Therefore, an object of the present invention is to provide apparatus for bi-directional ankle exercises, where movements are not confined to a single plane or direction. A second object is to provide apparatus for implementing the manual method of rehabilitation therapy as shown below. A third object is to provide resistance for these bi-directional movements according to a progressive weight training program. Yet a further object is that such apparatus be suitable for professionally unsupervised use in a gymnasium or home environment.

SUMMARY OF THE INVENTION

The present invention addresses the aforesaid objects with improved exercise methods and apparatus. Herein, according to this invention, are disclosed exercise devices affording resistance to bi-directional ankle movements, for exercising the muscles acting to maintain balance and dynamic stability. The invention includes some details well known to the mechanical arts and therefore, not the subject of detailed discussion herein.

The present invention provides a method for progressive resistance training of the muscle groups key to maintaining balance and dynamic stability. Prior art ankle exercise machines providing external resistance are limited to unidirectional modes. Apparatus of the present invention however, mechanically restrains the ankle from undisciplined movement, while either enforcing ankle inversion, with plantarflexion, or ankle eversion, with dorsiflexion, while providing resistance for these movements.

A preferred embodiment of the present invention utilizes weights to provide an incrementally adjustable resistance to the exercise movement. The apparatus has a conventional main frame, wherein a vertical plane of symmetry extending through the middle of the main frame and the centrally located user's position, would show the two sides as essentially mirror images. A "U" shaped sub-frame is mounted to the main frame for pivotal movement about a transverse, horizontal axis at or near the ankles of a seated user. The sub-frame cross-bar is forward of the pivot axis and the sub-frame extends rearwardly, carrying a weight to resist pivotal movement. Alternatively, the weight may be carried forward of the pivot point to provide resistance against movement in the opposite direction.

Right and left pedal members are pivotally mounted to the cross bar of the "U" shaped sub-frame and interconnected with a linkage to make them pivot in opposite directions. As the sub-frame is caused to pivot about this first transverse axis, a motion transfer link causes both pedal members to pivot about second axes essentially perpendicular to, and intersecting the first transverse axis proximate the ankles of a user. In this manner, the pedal members are guided to approach full ankle inversion when the "U" shaped sub-frame is at the bottom of its pivotal range, and full eversion when at the top of its pivotal range.

Thus, with the weight located to the rear, as the cross-bar is pressed from the "up" towards the "down" position, the ankles move from eversion towards inversion and from dorsiflexion towards plantarflexion, thereby exercising muscles of the above first muscle group. With the weight located forward of the transverse axis, the cross-bar must be lifted from the "down" to the "up" position. The ankles move from inversion towards eversion and from plantar flexion towards dorsal flexion. In this manner, the muscles of the second group above are exercised. Thus, by progressive resistance exercises, the ankles can be strengthened to react in any plane, as necessary to maintain balance and dynamic stability.

BRIEF DESCRIPTION OF THE DRAWINGS

A more complete understanding of the present invention may be had by reference to the following Detailed Description when taken in conjunction with the accompanying drawings wherein.

DETAILED DESCRIPTION OF THE INVENTION

Figure 1:
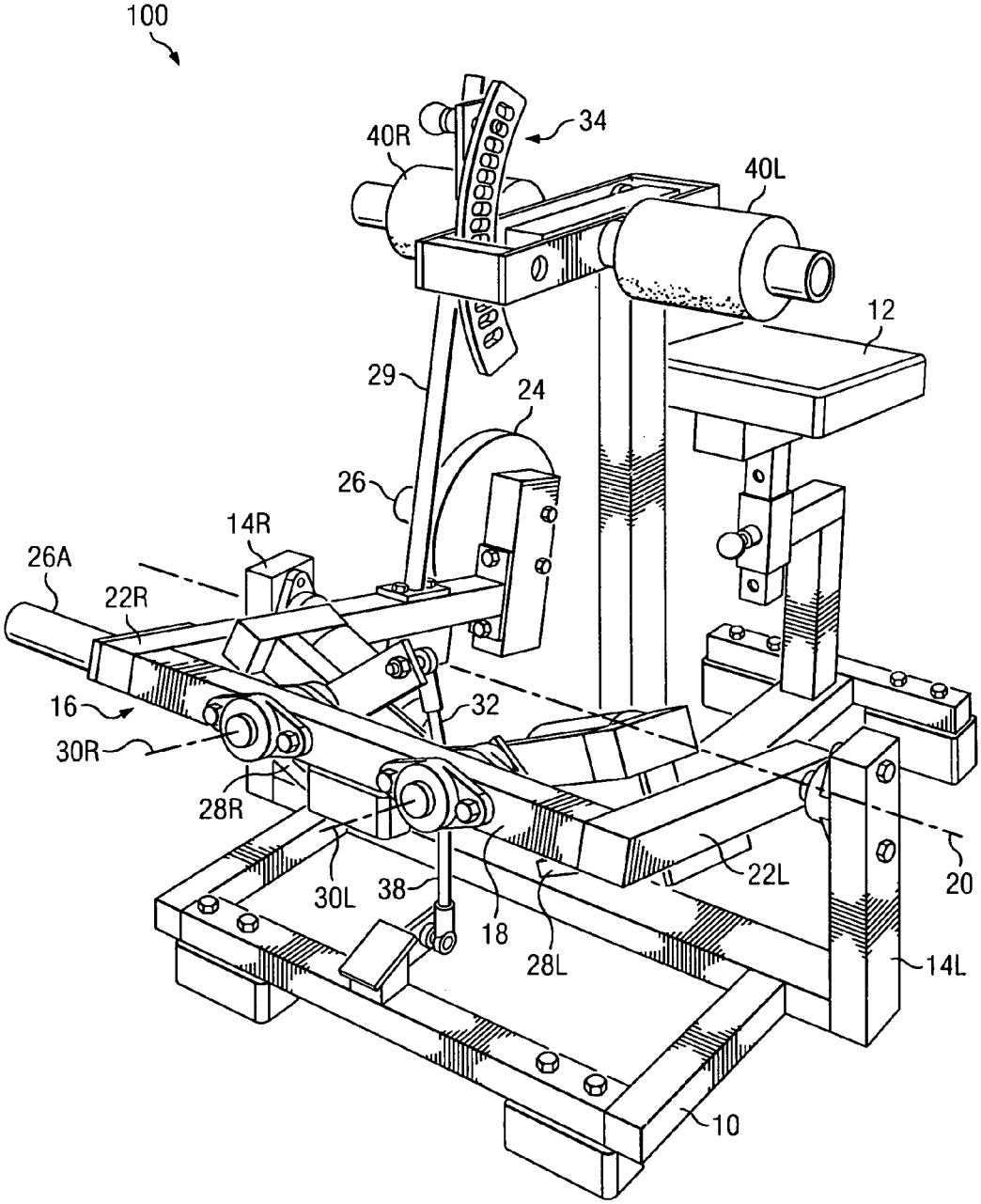
FIG. 1 is a front view of a preferred embodiment of a bi-directional ankle exercise machine according to the present inventions, shown as it appears at the beginning of an exercise in the first exercise mode, during which the ankles will move, with plantarflexion, from eversion toward inversion.

A preferred example of the present invention is described with reference to the above listed drawings showing how the invention can be made and used. Throughout FIGS. 1-6, the reference characters indicate the same or corresponding parts. It is to be understood that the preferred embodiment shown and described herein is exemplary, and may be expressed in other forms within the scope of the invention. Moreover, certain details are well known in the mechanical arts, and as such, may not be shown or described.

The present invention provides a method for progressive resistance training of those muscle groups which are key to maintaining balance and dynamic stability. By enforcing bidirectional exercise movements, while restraining the ankle from undisciplined movement, an exercise machine of the present inventions makes it possible to provide effective resistance in multi-directional modes. In this manner, an exercise program of progressive resistance can strengthen and rehabilitate these key muscle groups.

FIGS. 1-6 illustrate a preferred embodiment 100 of a bi-directional exercise machine for the ankle employing the methods of the present inventions. In FIG. 1, embodiment 100 is shown to have a conventional base and main frame 10, wherein an imaginary central plane of symmetry would show the two sides to more or less be mirror images. In this embodiment, the user is positioned and supported by centrally located, adjustable height, user's seat 12. Each side of main frame 10 has a vertical column 14R or 14L, positioned somewhat to the front of seat 12 to provide mounting for transverse axis 20, which passes approximately through the location of the ankles of a seated user. Side frame members 22R and 22L of "U" shaped sub-frame 16 are mounted to vertical columns 14R and 14L of main frame 10 for pivotal movement about transverse, horizontal axis 20. Sub-frame 16 includes cross-bar 18, joining side frame members 22R and 22L, well forward of transverse horizontal axis 20. Adjustable resistance to such pivotal movement is provided by weight 24, which may comprise individual plates, added incrementally at the user's option. Weight 24 is carried on weight horn 26 of rearwardly extended sub-frame side member 22R. Alternatively, weight 24 may be carried on weight horn 26A, forward of transverse axis 20, to provide resistance against movement in the opposite direction. Thus, either mode can be made to require exercise force input.

Figure 2:
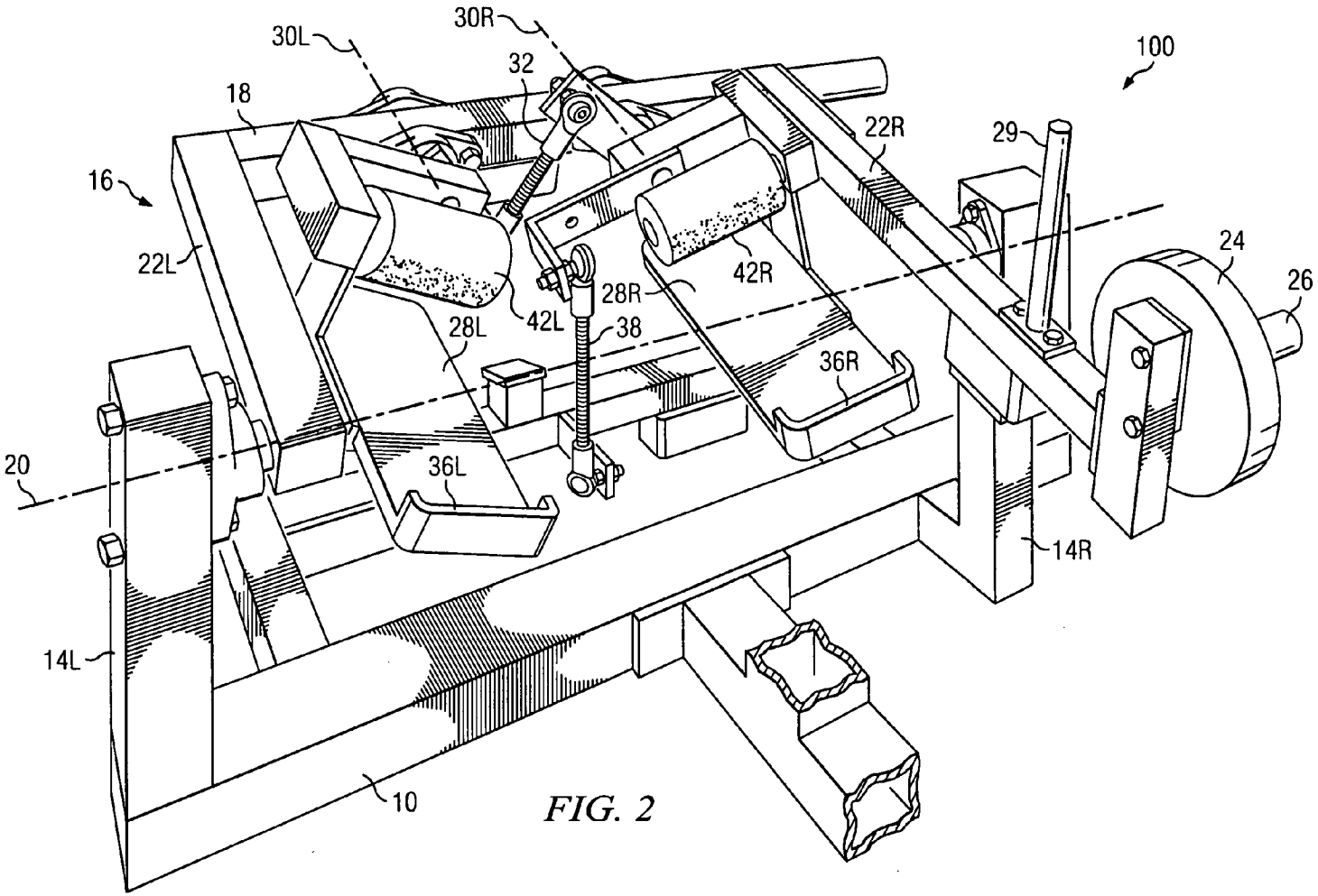
FIG. 2 is a three-quarter rear view of the embodiment of FIG. 1 in the first first exercise mode, at the beginning of an exercise movement.

Looking at FIGS. 1 & 2, right and left pedal members 28R and 28L are pivotally mounted to sub-frame 16 at cross bar 18 and interconnected by linkage 32 to pivot in opposing directions. As sub-frame 16 is caused to pivot about transverse axis 20, motion transfer link 38, connected between frame 10 and pedal member 28R, simultaneously forces pedal members 28R and 28L to pivot about axes 30R and 30L, which are essentially perpendicular to transverse axis 20. Pedal members 28R and 28L approach full ankle inversion when "U" shaped sub-frame 16 is at the bottom of its pivotal range, and full eversion when at the top of its pivotal range. Right and left thigh constraining pads 40R and 40L are adjustable through pin-and-hole positioning mechanism 34, to contact a user's thighs while forcing upward movement of sub-frame 16. Thus, thigh movement is constrained, preventing upper leg participation in the ankle exercise movements, thereby maintaining exercise movement integrity. The pedal exercise force input location for upward movement is provided by foot restraints 42R and 42L.

Manual input lever 29 extends upwardly from "U" shaped sub-frame side member 22R, so as to allow manual cycling of interconnected pedals 28R/28L and sub-frame 16. Use of manual input lever 29 allows a therapist or trainer to move the ankles of a user through the ideal range of motion to flex, rehabilitate or strengthen the subject muscles. Thus, the therapist, trainer, or even the user, can monitor the exercise movement resisting force, increasing or reducing it according to the perceived need.

With weight 24 located to the rear, on weight horn 26, as sub-frame 16 is pressed from the "up" towards the "down" position, the ankles move from eversion towards inversion and from dorsiflexion towards plantarflexion, so that muscles of the above first group are exercised. With weight 24 located forward of transverse axis 20 on weight horn 26A, cross-bar 18 must be lifted from the "down" to the "up" position. Frame link 38 connected between main-frame 10 and pedal member 28R interconnects pivotal pedal movement about axis 30R (and 30L), with sub-frame pivotal movement about transverse axis 20. In this manner, ankle movements of inversion and eversion are coupled with movements of dorsiflexion and plantarflexion. This coupling provides the movement discipline required for systematic progressive resistance exercises and thereby, the ankles can be strengthened to act in any plane necessary to maintain balance and dynamic stability.

FIG. 2 clearly shows cross bar 18 of "U" shaped sub-frame 16 at the uppermost limit of its pivotal range, with pedal members 28R and 28L consequently everted. Here it is also seen how the connection of frame link 38 to main frame 10 acts to impose the inversion/eversion movement of pedal member 28R in accompaniment with the dorsi/plantar pivotal movement of "U" shaped sub-frame 16. Perhaps more clear in this view is the manner in which interconnecting linkage 32 acts to coordinate the opposed inversion/eversion movements of pedal members 28R and 28L. Foot restraints 42R and 42L enable heel and toe force input for dorsiflexion exercises during upward movement of cross-bar 18. Heel stops 36R and 36L locate the feet properly on right and left pedal members 28R and 28L for heel contact dorsiflexion input and toe contact plantarflexion input.

Figure 3:
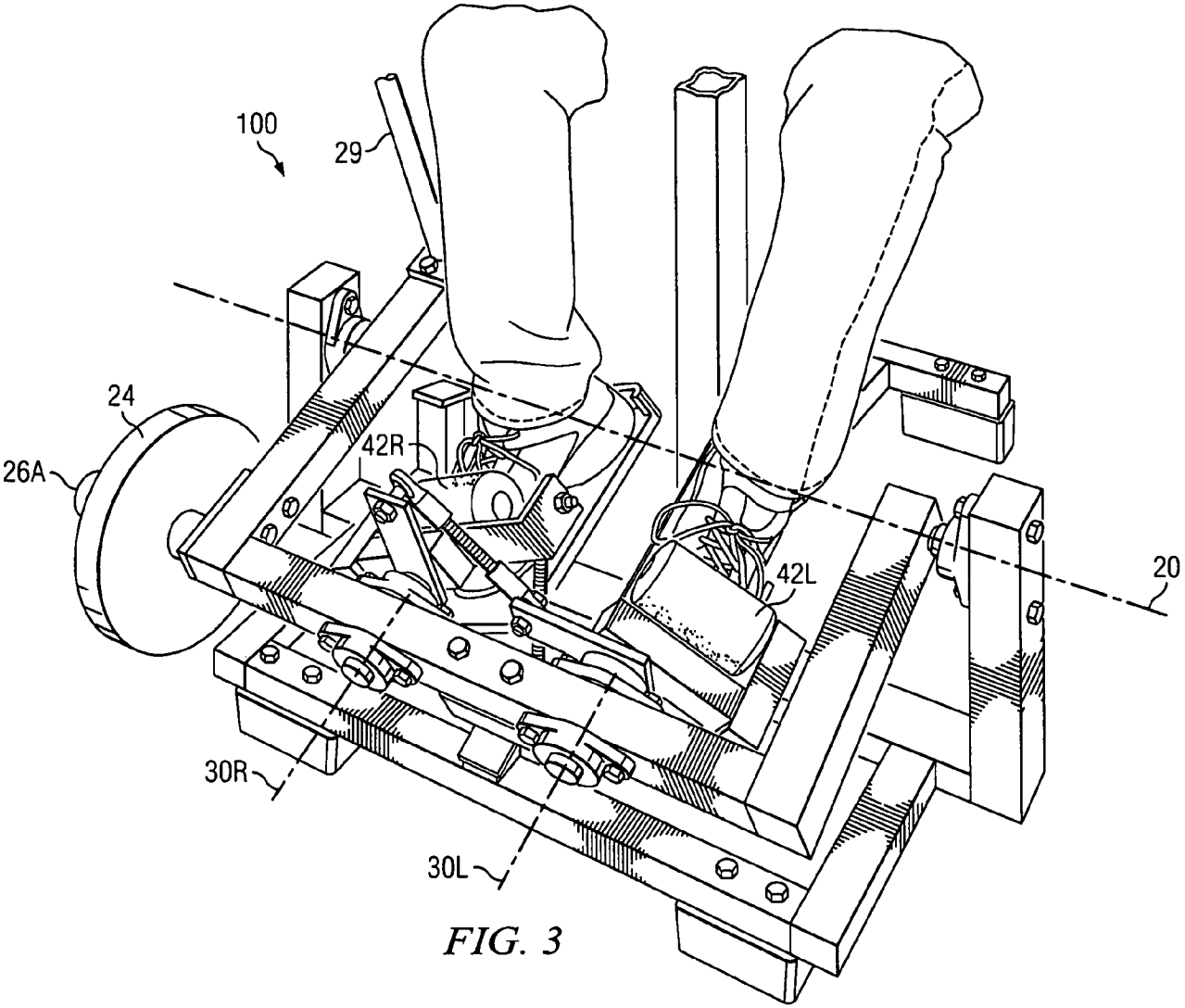
FIG. 3 is a front view of the embodiment of the present invention, in the second exercise mode, at the beginning of a movement during which the ankles will move, with dorsiflexion, from inversion toward eversion.
Figure 4:
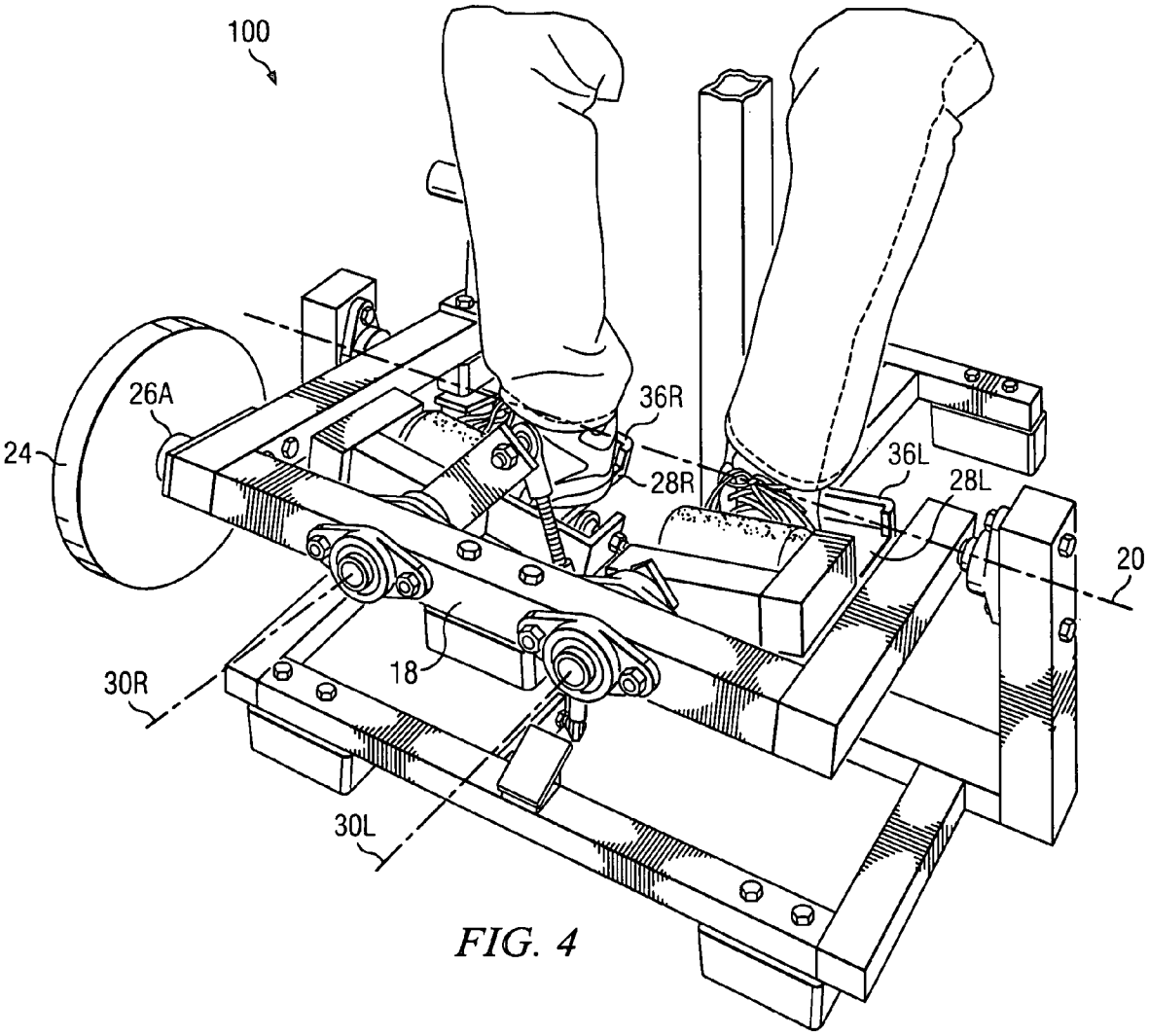
FIG. 4 is a three-quarter front view, showing the embodiment of FIG. 3 at completion of a second mode exercise movement.

FIGS. 3 and 4 show preferred embodiment 100 at the beginning and ending positions of a second mode exercise movement, with weight 24 carried on weight horn 26A, to the front of cross-bar 18. As shown in FIG. 3, at the lower end of the pivotal range of cross-bar 18, pedal members 28R and 28L have pivoted about axes 30R and 30L to their fully inverted position. in FIG. 4, at the upper end of the pivotal range of cross-bar 18, pedal members 28R and 28L have pivoted to an everted position. Simultaneous to this symmetrical ankle movement from inversion toward eversion, pedal members 28R and 28L have also pivoted about transverse axis 20, causing the ankles to move from plantarflexion toward dorsiflexion.

Notably, we see the perpendicular intersection of axes 30R and 30L with transverse axis 20 at or very near the subject joint, as is critical to bidirectional exercise movements. Thus, second mode exercises using preferred embodiment 100 of the present invention serve to exercise and develop the muscles acting for eversion and dorsiflexion, including: the extensor digitorum longus, the peroneus longus, the peroneus brevis and the tibialis anterior.

Figure 5:
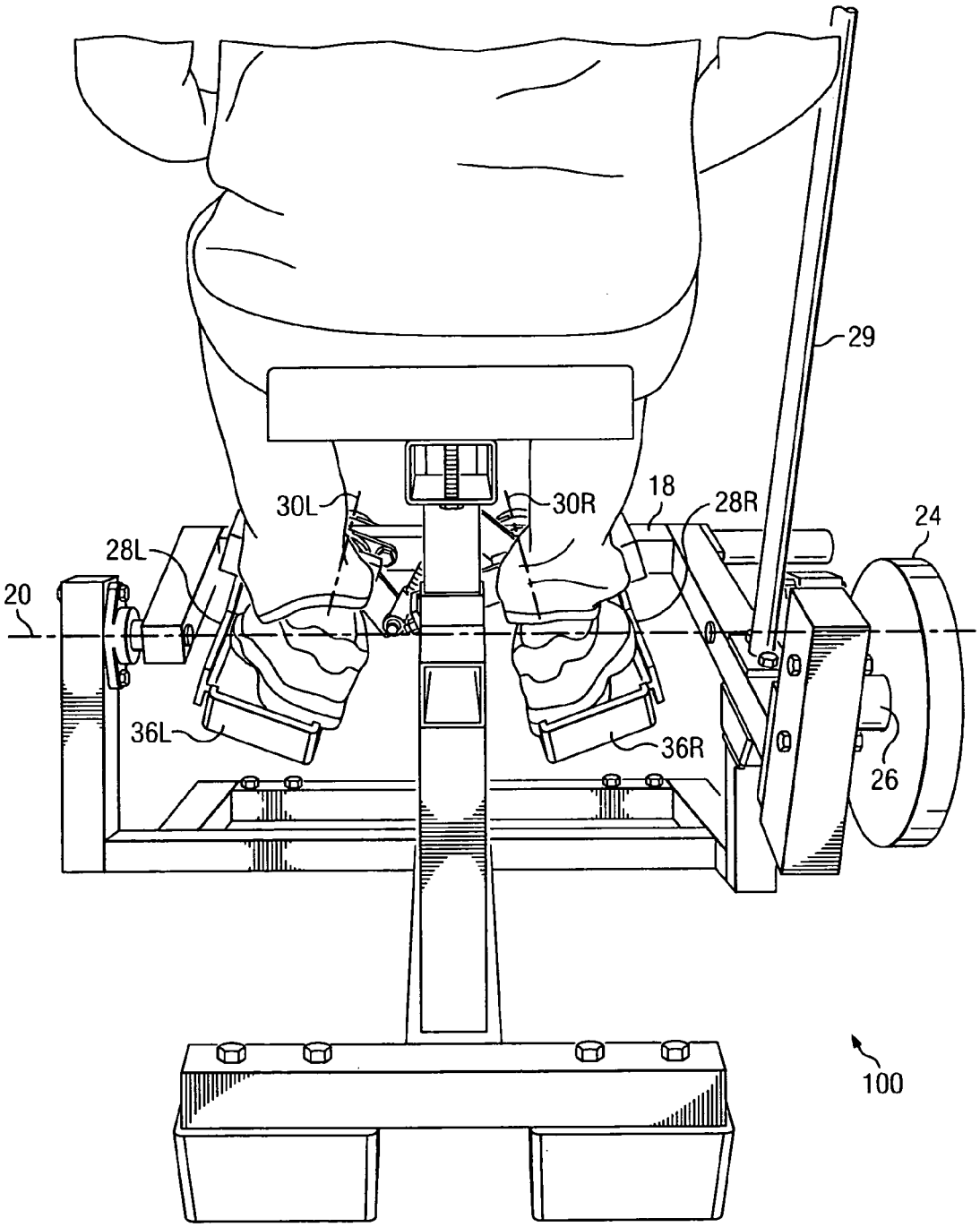
FIG. 5 is a rear view of the embodiment of FIG. 1, at the beginning of a first mode exercise movement.
Figure 6:
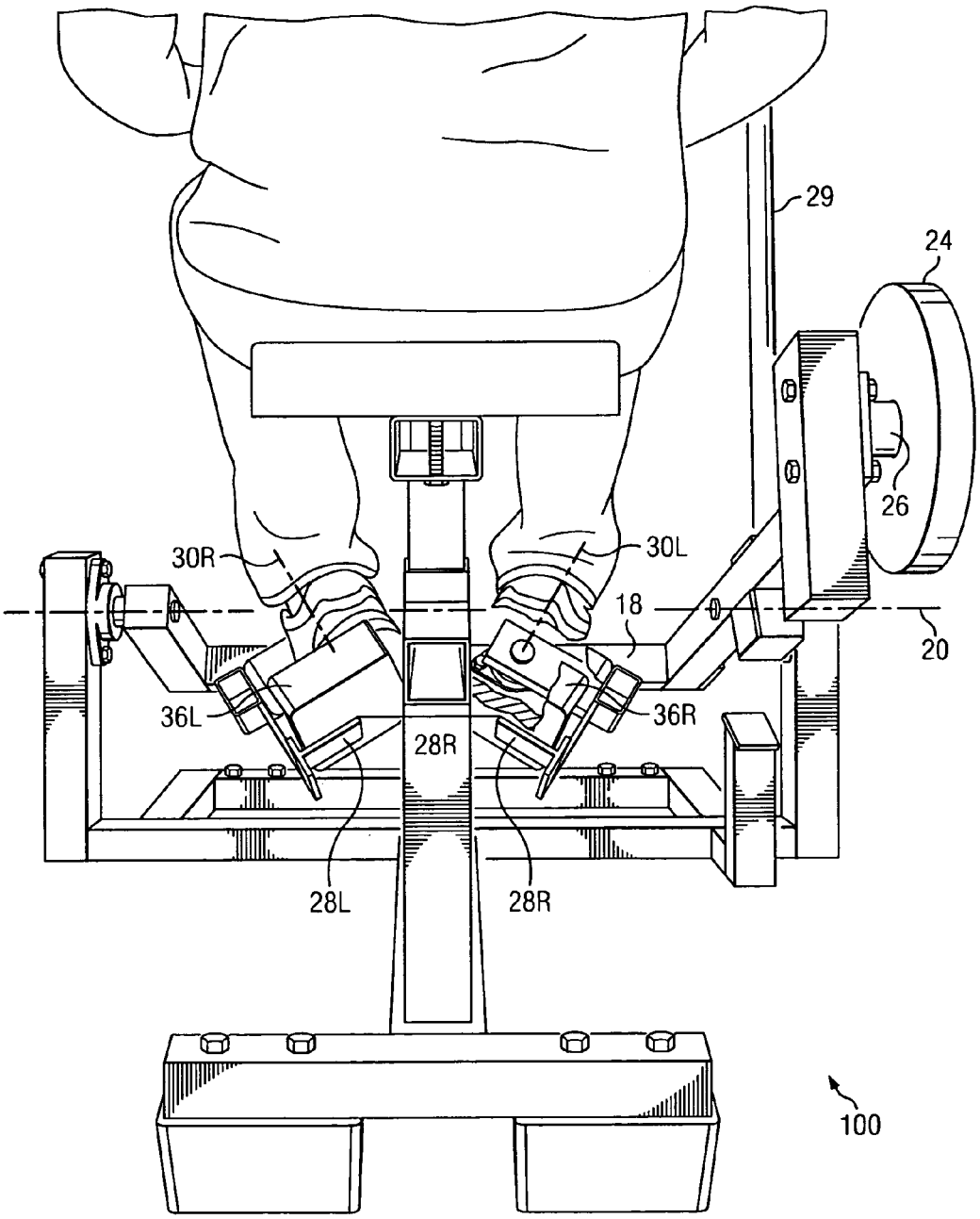
FIG. 6 is a rear view of the embodiment of FIG. 1, at completion of a first mode exercise movement.

FIGS. 5 and 6 show preferred embodiment 100 at the beginning and ending positions of a first mode exercise movement, with weight 24 carried on weight horn 26, to the rear of cross-bar 18. As shown in FIG. 5, at the upper end of the pivotal range of cross-bar 18, pedal members 28R and 28L have pivoted about axes 30R and 30L to their fully everted position. in FIG. 6, at the lower end of the pivotal range of cross-bar 18, pedal members 28R and 28L have pivoted to an inverted position. Simultaneous to this ankle movement from eversion toward inversion, pedal members 28R and 28L have also pivoted about transverse axis 20, causing the ankles to move symmetrically from dorsiflexion toward plantarflexion. Again, we see the critical intersection of axes 30R and 30L with transverse axis 20, at or very near the ankle joint, as is critical to bidirectional exercise movement. Thus, first mode exercises, using preferred embodiment 100 of the present invention, serve to exercise and develop the muscles acting for inversion and plantarflexion, including: the tibialis Posterior, the flexor digitorum longus, the peroneus longus, the peroneus brevis, the soleus and the gastrocnemius.

In the above described manner, the stated objects of the present inventions are fully realized. Apparatus is provided for implementing the manual method of rehabilitation therapy, as described above, by mechanically enforcing the prescribed bi-directional ankle exercise movements. Furthermore, the methodology is enhanced by the capability to provide resistance for these movements according to a progressive weight training program. Thus, balance and dynamic stability associated muscles can be strengthened in a gymnasium or home environment and, inasmuch as the user can adjust the apparatus and select an appropriate resistance, the apparatus is suitable for professionally unsupervised use.

It is to be understood that the methods and apparatus of the above-described invention, may be expressed other embodiments, through modification or substitution of parts or steps, so that that the present invention is not limited to the disclosed embodiment. Although a preferred embodiment has been illustrated in the accompanying drawings and described in the foregoing Detailed Description, it will be understood that the inventions are not limited to the embodiment disclosed but, may include other expressions within the scope of the following claims.

I claim:

1. A method for bi-directional ankle exercise movements, comprising the steps of:

providing a pedal member mounted for coupled bi-directional pivotal movement about two perpendicular axes;

positioning a user's foot on the pedal member for doing prescribed ankle exercise movements;

restraining the user's foot and ankle from undisciplined movement with respect to the pedal member;

coupling ankle inversion movement with plantarflexion through pivotal movement of the pedal member;

coupling ankle eversion movement with dorsiflexion through pivotal movement of the pedal member; and resisting such movements with a selected force.

2. Apparatus for bi-directional ankle exercise movements, comprising:

a main-frame including a base and upwardly extending columns at either side thereof;

a support for positioning a user;

a sub-frame mounted so that a cross member thereof pivots parallelly about a horizontal first axis passing transversely at or near the ankles of the user;

right and left pedal members mounted to the sub-frame cross member for pivotal movement about right and left second axes, perpendicular to and intersecting the horizontal first axis, and having an interconnected linkage, so that the right and left pedal members are caused to pivot in opposite directions;

a motion transfer linkage whereby pivotal movement of the pedal members about the first axis will simultaneously force pivotal movement of the pedal members about their respective second axes.

3. The apparatus of claim 2 wherein the support is an adjustable height seat.

4. The apparatus of claim 2 and further comprising:

an incrementally adjustable weight opposing pivotal movement of the "U" shaped sub-frame in a downward direction, so that selected ankle exercise forces may be exerted against the right and left pedal members for downward movement of the sub-frame.

5. The apparatus of claim 2 and further comprising an adjustment for varying the seat height.

6. The apparatus of claim 2 and further comprising a lever for manually effecting movement of the right and left pedals about the first and second axes.

7. The apparatus of claim 2 and further comprising:

an incrementally adjustable weight opposing such simultaneous pivotal movement of the sub-frame about the right, left and horizontal axes, so that an exercise force must be exerted therefor.

8. The apparatus of claim 2 and further comprising:

the right and left pedal members further including foot restraining members to provide for ankle exercise forces exerted for upward movement of the "U" shaped sub-frame.

9. The apparatus of claim 2 and further comprising:

the right and left pedal members further including thigh constraining members to prevent upper leg participation in ankle exercise movements.

10. The apparatus of claim 7 and further comprising:

an incrementally adjustable weight opposing pivotal movement of the "U" shaped sub-frame in an upward direction, so that selected ankle exercise forces may be exerted upwardly against the right and left foot restraining members for upward pivotal movement.

11. Apparatus for bi-directional ankle exercise movements, comprising:

a main-frame including a generally symmetrical base, with a centrally mounted seat for supporting a user and columns extending upwardly at each side thereof to provide for a horizontal first axis passing therethrough at the approximate location of a user's ankles;

a "U" shaped first sub-frame, with a cross-bar located forward of the horizontal first axis and essentially horizontal sides, mounted to pivot up and down about the horizontal first axis;

right and left pedal members mounted to the sub-frame cross bar on right and left second axes respectively, so as to pivot in symmetrical user inversion and eversion movements, the second axes being perpendicular to and intersecting the first axis; and a motion transfer linkage whereby pivotal movement of the cross-bar about the horizontal axis simultaneously forces pivotal movement of the pedal members about their respective second axes.

12. The apparatus of claim 11 and further comprising:

a resisting force opposing pivotal movement of the cross-bar, so that an exercise force must be exerted therefor.

13. The apparatus of claim 11 and further comprising a lever for manually effecting movement of the right and left pedals about the first and second axes.

14. The apparatus of claim 11 and further comprising:

an incrementally adjustable weight opposing such simultaneous pivotal movement of the sub-frame about the right, left and horizontal axes, so that an exercise force must be exerted therefor.

15. The apparatus of claim 11 and further comprising:

the right and left pedal members further including foot restraining members to provide for ankle exercise forces exerted for upward movement of the "U" shaped sub-frame.

16. The apparatus of claim 11 and further comprising:

the right and left pedal members further including thigh constraining members to prevent upper leg participation in ankle exercise movements.

17. The apparatus of claim 11 and further comprising:

an incrementally adjustable weight opposing pivotal movement of the "U" shaped sub-frame in an upward direction, so that selected ankle exercise forces may be exerted upwardly against the right and left foot restraining members for upward pivotal movement.

* * * * *